US005989092A

United States Patent [19]

McGowan et al.

[11] Patent Number: 5,989,092

[45] Date of Patent: Nov. 23, 1999

[54] INTERACTIVE TOY

[75] Inventors: Joseph McGowan, St. Peters; Ryan Wolfinbarger, St. Louis; James Russell Hornsby, Chesterfield, all of Mo.

[73] Assignee: Trendmasters Inc., St. Louis, Mo.

[21] Appl. No.: 08/691,386

[22] Filed: Aug. 2, 1996

[51] Int. Cl.[6] ..... A63H 30/00; G09F 19/08

[52] U.S. Cl. ..... 446/175; 40/411

[58] Field of Search ..... 40/411, 414, 455; 446/175, 219, 297, 303, 308, 309, 310, 311, 312, 236, 437, 454, 485

[56] References Cited

U.S. PATENT DOCUMENTS

| | | | |
|---|---|---|---|
| 530,870 | 12/1894 | Wenger | 40/411 |
| 2,961,794 | 11/1960 | Sachs et al. | 40/411 X |
| 3,525,169 | 8/1970 | Odenwald | 40/455 X |
| 3,623,251 | 11/1971 | Bosch | 40/455 |
| 4,479,329 | 10/1984 | Fraden | 446/175 |
| 4,643,692 | 2/1987 | Magers | 446/236 X |
| 4,844,474 | 7/1989 | Schaub et al. | 446/175 X |
| 4,910,647 | 3/1990 | Gong | 40/411 X |
| 4,930,236 | 6/1990 | Hart | 446/175 X |
| 4,943,256 | 7/1990 | Symons | 446/437 X |
| 5,003,714 | 4/1991 | Saroh et al. | 446/175 X |
| 5,310,375 | 5/1994 | Kanauchi | 40/411 X |
| 5,451,180 | 9/1995 | Chan et al. | 40/411 X |
| 5,522,758 | 6/1996 | Liu et al. | 40/411 |

FOREIGN PATENT DOCUMENTS

| | | | |
|---|---|---|---|
| WO 87/06487 | 11/1987 | WIPO | 446/175 |

*Primary Examiner*—D Neal Muir
*Attorney, Agent, or Firm*—Dorsey & Whtiney LLP

[57] ABSTRACT

The present invention is an automatically interactive toy capable of responding to natural triggering events, such as motion in the vicinity of the toy, and providing a plurality of interactive responses. Specifically, the toy configuration senses a natural triggering event with a sensor which activates the interactive response. Upon the occurrence of the natural triggering event, the triggering sensors activates an actuator containing a motor and a series of gears. The motor drives the series of gears to create a response by a transformation mechanism. In the preferred embodiment, the transformation mechanism causes an object or toy configuration to transform from a closed to an open position. Thus, the toy or object may have one appearance when closed and a different appearance when opened to expose an inner chamber which may contain a secondary object or toy.

1 Claim, 7 Drawing Sheets

INTERACTIVE TOY

TECHNICAL FIELD

This invention pertains to an automatically interactive toy. More particularly, it relates to a toy which automatically responds to a variety of triggering events and provides a plurality of corresponding responses, including opening its exterior configuration to reveal an inner chamber.

BACKGROUND

Toy manufacturers are constantly trying to design new and improved ways to capture and maintain a child's imagination. Unfortunately for toy manufacturers, there is no formula to decide whether or not a toy will be successful. In fact, in many cases, it seems completely arbitrary why one toy is successful and another similar toy is not.

For example, although there will always be a market for traditional dolls, today's most popular dolls are dolls that cry when the child pulls a string, dolls that laugh when the child pushes their stomach, or any doll that interacts with the child. The commonality between these toys is that they all interact with the child based on the child's manual inputs. Thus, any invention which enables a toy to more actively interact with the child is a considerable improvement over the prior art.

In addition, it is equally important for toys to interact naturally. Toys on the market today do not. For example, although it is natural for a baby to cry, it is not natural for a person to cause the baby to cry by pulling a string. Thus, besides increasing a toy's ability to interact, it is also a considerable improvement over the prior art to design a toy that interacts without requiring the child to intentionally initiate the response.

Another example of a presently successful toy design is the design of transformer toys. Transformer toys are toys that allow the child to manually change the toy from one form to another, like a toy that changes from an action figure into a car or a plane. These toys have been successful because they are really two toys in one, and they allow the child's imagination to envision the toy in at least twice as many possible scenarios. For instance, an action figure limits a child's imagination to a scenario associated with an action figure, but if the action figure changes into a car, the child may imagine any scenario which involves an action figure, or a car, or any scenario including the conversion of the toy from one form to the other. Thus, any invention which creates a new way to include two toys in one is a considerable improvement over the prior art, especially, if the toy is able to transform in response to a natural or indirect triggering event.

It will therefore be apparent that it is desirable and commercially attractive to provide a new type of toy which interacts with a child based on the occurrence of one or more natural triggering events. Such device would execute a plurality of automatically interactive responses based on one or more natural triggering events in order to automatically transform its shape. Such a transformation could cause the device to open to reveal an inner chamber. The effect would be to provide a child with a plurality of toys initially embodied in a single toy device.

SUMMARY OF THE INVENTION

The present invention is an automatically interactive toy which offers an improved design which captures a child's imagination. In the present invention, a natural triggering event automatically initiates a toy to opens its exterior configuration and reveal an inner chamber.

Unlike existing toys, the present invention receives natural triggering events which may be remote from the toy, with a triggering means. If the triggering means senses such a triggering event, it activates a motor which generates motion to transform the toy. In the preferred embodiment, the motion generated by the motor is conveyed by a series of gears to a transformation means which acts through a gear train driven by the motor to create a physical response in the form of opening the toy's exterior configuration to reveal an inner chamber containing a small figure.

A more naturally interactive toy is a considerable improvement over existing toys because it does not require the child to intentionally direct the toy to interact. The present invention offers improved interactivity because it is capable of responding to natural triggering events. For example, a toy figure that transforms simply because the child walks past it is more realistic than a toy figure than transforms because the child manually reconfigured the parts. Further, the present invention is not limited to one triggering event or one response; rather, the present invention can provide a plurality of interactive responses based on a plurality of triggering events, enhancing the child's experience.

The present invention is also a new way to include a plurality of toys in one. In the preferred embodiment, the toy's response to a triggering event is to open its exterior configuration and reveal an inner chamber and to make a loud roaring sound while doing so. As a result, the present invention may include a plurality of toys in one because it may contain a plurality of different accessories or other toys inside its inner chamber. Thus, unlike the existing transformer toys which either exist in one form or another, the present invention provides the child with several toys in one, and the ability to play with each at the same time.

It is an object of the present invention to create a new and improved type of toy.

It is an object of the present invention to provide a toy which interacts with a child based on the occurrence of one or more natural triggering events.

It is an object of the present invention to provide a toy which executes a plurality of automatically interactive responses based on one or more natural triggering events.

It is an object of the present invention to provide a toy which automatically transforms its shape in response to a triggering event.

It is an object of the present invention to provide a toy which opens an exterior toy configuration and reveal an inner chamber.

It is an object of the present invention to provide a toy which gives a child a plurality of toys initially embodied in one toy configuration.

These and other objects and advantages of the invention will become clear upon a review of the following detailed description of the invention and the claims appended thereto.

DESCRIPTION OF THE PREFERRED EMBODIMENT

Figure 1:
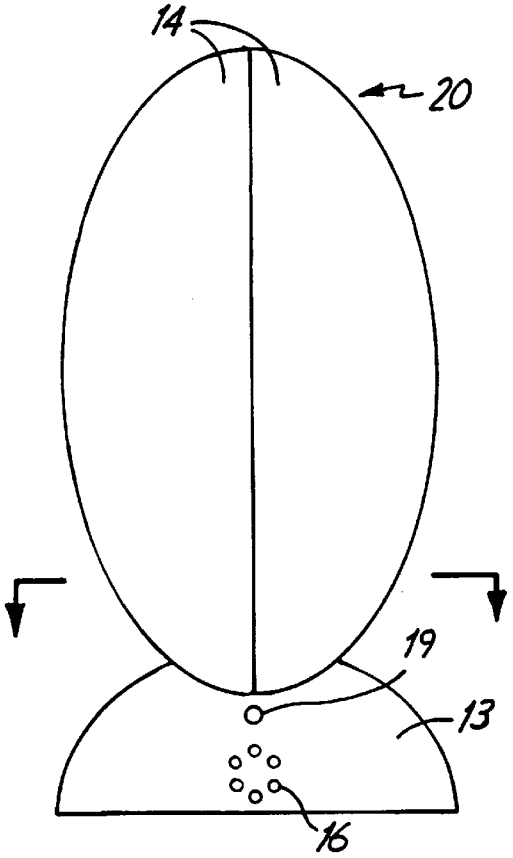
FIG. 1. shows a front view of an object in its closed or home position.

A toy constructed in accordance with the principles of the present invention is shown in FIG. 1 and is generally designated 20. The toy 20 includes a base 13 and a pair of confronting object parts or portions 14 which establish the initial appearance of the object 20 which forms the outer housing of the predominant or upper portion of the invention. The object 20 may assume any appearance or configuration. As examples, the object 20 could be a head, a ball, a box, a barrel, or a toy vehicle.

Figure 2:
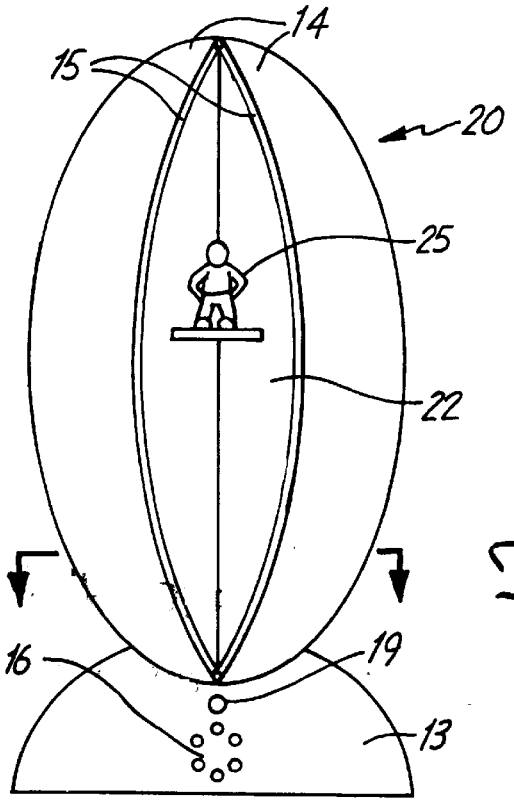
FIG. 2. shows a front view of an object in its open position revealing an inner chamber containing a small figure.

The front or face of the object 20 is split vertically and is constructed and configured to open to reveal an internal chamber 22 and a secondary object 25 within the chamber 22. The inner chamber 22 is formed within and circumscribed by the parts or portions 14 of the object 20. As shown in FIG. 1, the portions 14 are opposed symmetrical members, each of which is formed as a hollow cupped unit defined by a continuous curved wall. The edges 15 of the portions 14 are abutting or confronting when the object 20 is in its normally closed position, as shown in FIG. 1. The edges 15 are separated or moved away from one another when a triggering event occurs to bring the object into an open position, as shown in FIG. 2, to reveal the inner chamber 22 formed within the object portions 14. The toy 20 is supported upon a base 13. The base 13 rotatable supports the two object portions 14 and contains the means or mechanisms which cause the object parts or portions 14 to open and close in response to a triggering event sensed by the triggering means 19.

FIG. 2 shows the two object parts 14 of the toy 20 in its opened position, which reveals an inner chamber 22 that contains a small figure 25 or secondary toy. The secondary toy 25 can be supported in any suitable manner, by the base 13 or supported from any part of the inner chamber walls. The toy 20 shown is configured in the form of a head which, upon the triggering event, opens to reveal a small interior figure 25. As noted, the portions 14 of the toy open in response to a natural triggering event. A natural triggering event is an event which initiates the toy's response without requiring any intentional physical manual manipulation, such as flipping a switch or pulling a string on the toy, to stimulate the response. For example, a child could leave the toy on the shelf and the toy would, upon the occurrence of a natural triggering event, interact with the child without the child intentionally interacting with the toy 20.

Figure 3:
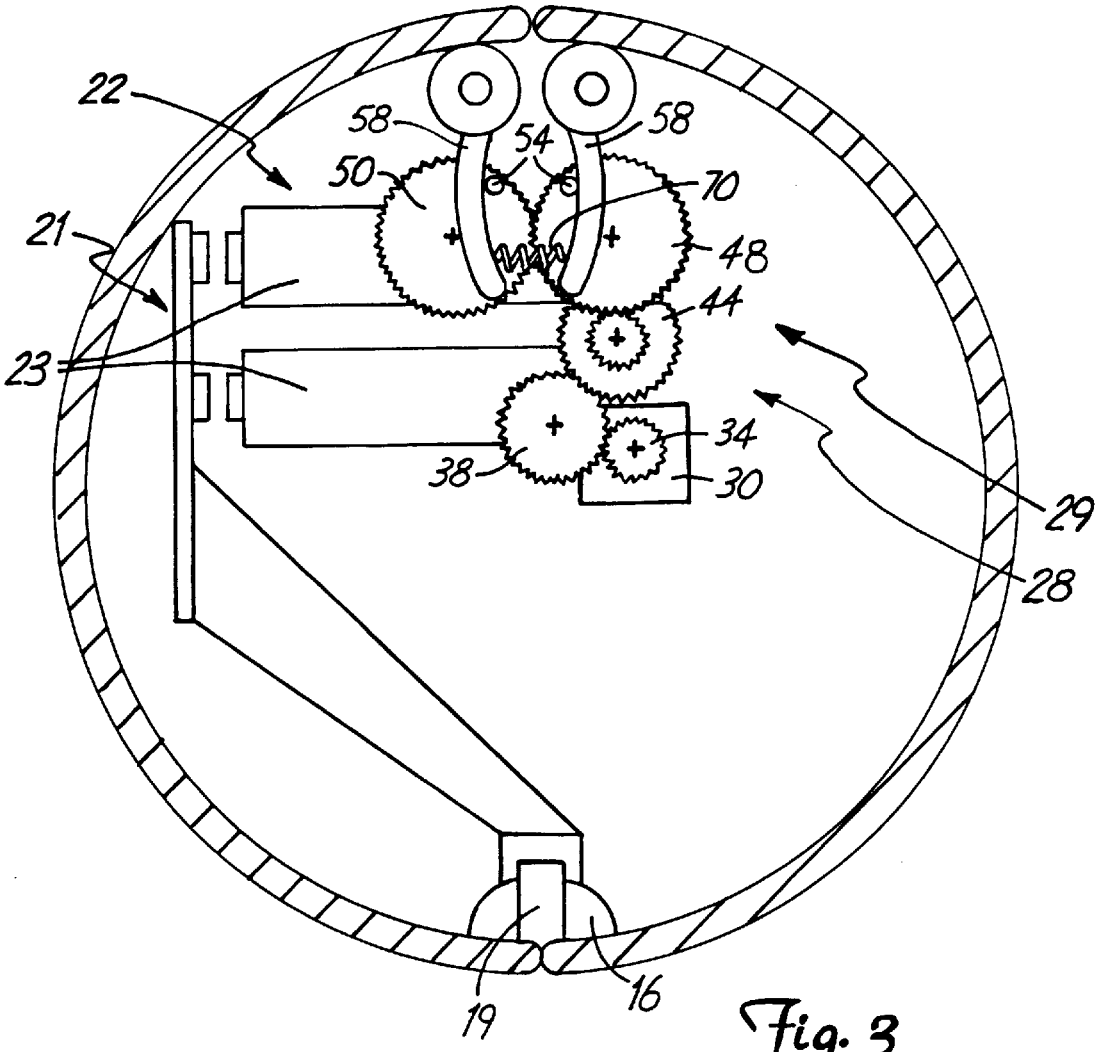
FIG. 3. shows a top view of an actuator mechanism, a sound card, and a speaker within the object.

A triggering means or mechanism 19, and a speaker 16 are also associated with the base 13. FIG. 3 shows the triggering means 19, power supply 22, sound card 21, and speaker 16 located below the actuator 28 in the base 13. The triggering means 19 could be any type of sensor responsive to light, temperature, motion, pressure or sound, or could be a timing device. In the preferred embodiment, the triggering means 19 is a CDS (cadmium sulfate) light sensor. Thus, when the normal light stream received by the sensor 19 changes, the CDS light sensor turns on an actuator 28, shown in FIG. 3, located inside the toy 20. The interruption can occur by any movement in front of the sensor 19 or even by walking past the sensor 19.

Figure 4:
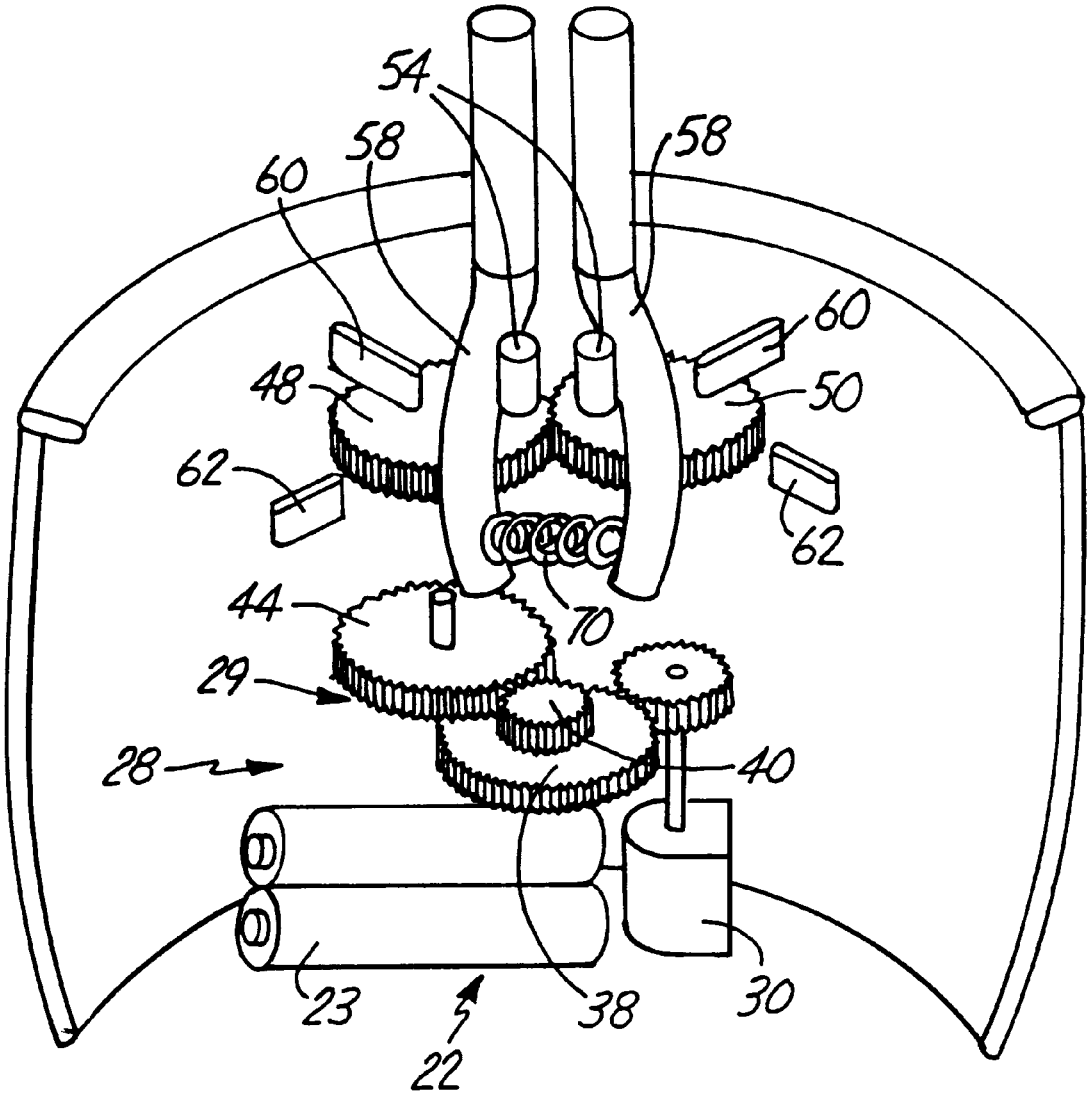
FIG. 4. is a perspective view of the actuator mechanism when the object is in its closed position.
Figure 5:
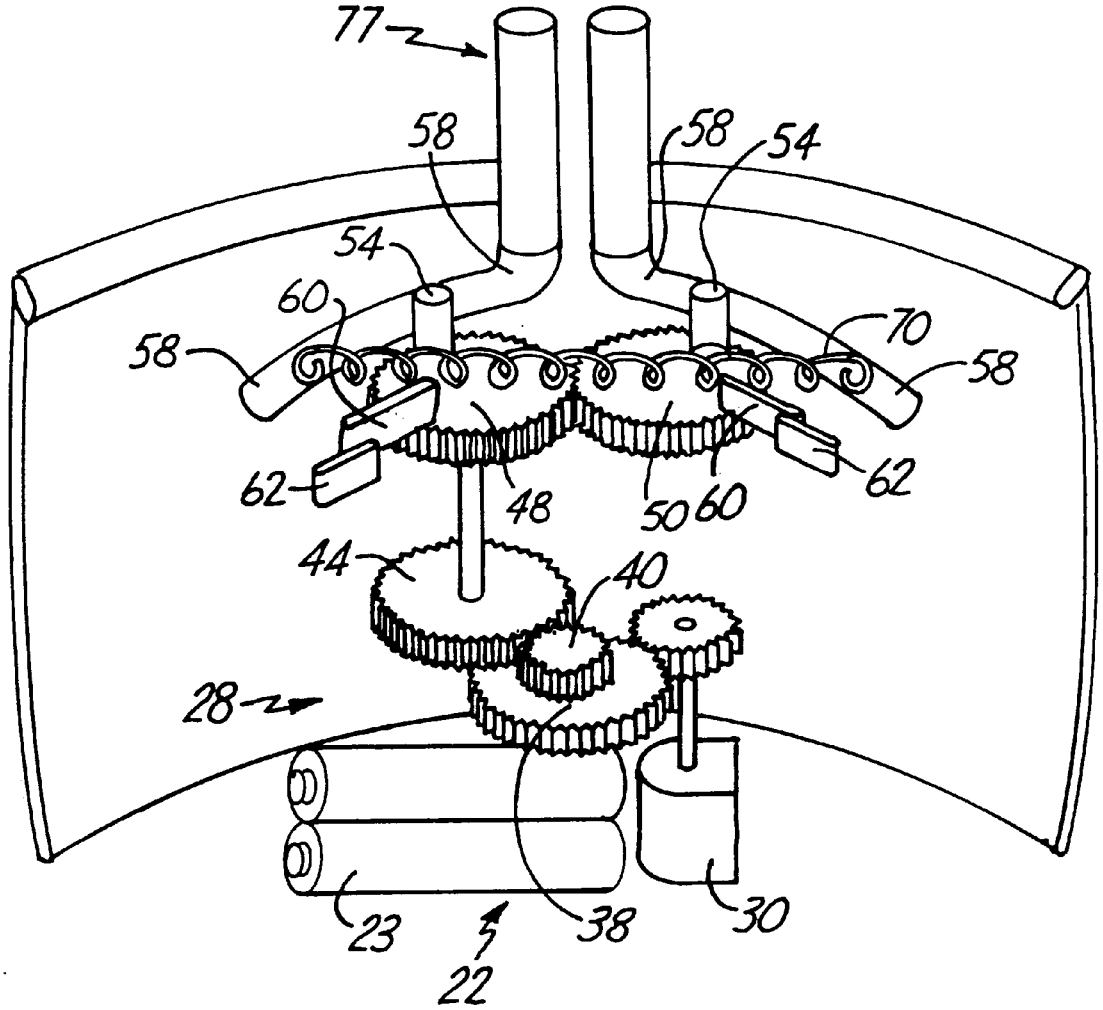
FIG. 5. is a perspective view of the actuator mechanism when the object is in its open position.

The actuator 28, which initiates the toy's 20 motion response, is located inside of the toy 20, as shown in FIGS. 3–5. The triggering means 19 and the actuator 28 can cause the toy 20 to open and close, or perform any of a plurality of different responses, including motion, sound, light, or the like. When triggered, the sound card 21 can initiate an audio response while the object 20 is opening and closing, and this audio response can be communicated through speakers 16. If the embodiment is intended to be an object capable of speaking, the speaker 16 could be located near the object's mouth.

In the preferred embodiment, upon the triggering event, the actuator's motor 30 is also activated. The motor 30 may be an AC or DC motor powered by any suitable power supply 22 such as a battery or power cord. In a preferred embodiment, the motor 30 is powered by two AA batteries 23 installed in the object's base 13.

A gear train 29, shown in FIGS. 3–5, converts the motion generated by the motor 30 into the motion desired to open the toy 20. The gear train 29 is a combination of gears which is used to control the speed distributed by the actuator 28. The gear train 29 includes a drive gear 34, control gear 38, transfer gear 44, and two push gears 48, 50. These gears may be made of metal or rigid plastic. The drive gear 34 is rotated directly by the motor 30. The control gear 38 receives its gear speed from the drive gear 34 and converts it into the desired gear speed to open the toy 20. The transfer gear 44 distributes the gear speed received from the control gear 38 to a first push gear 48. The first push gear simultaneously passes the gear speed to a second push gear 50. After the push gears 48, 50 receive the gear speed, the push gears 48, 50 convert the gear speed into the type of motion desired to open the toy 20.

Figure 6:
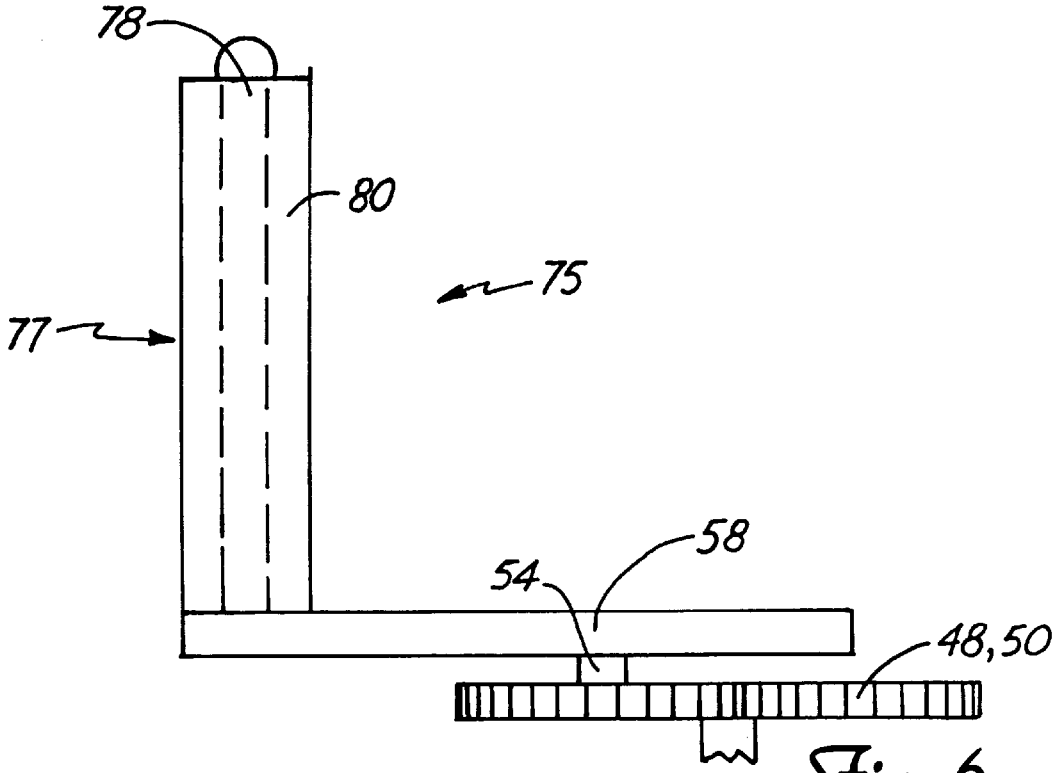
FIG. 6. shows a side view of the transformation mechanism which enables the object to open and close.

FIG. 6 shows the mechanism internal to the object 20 which enables it to open and close to transform the object 20. The transformation mechanism or means 75 includes a hinge 77, similar to a hinge for a door, comprising a sleeve 80 surrounding an upstanding hinge rod 78. The sleeve 80 is a cylinder which surrounds and rotates around the hinge rod 78, and is fixed to an object part 14, allowing the object part 14 to open and close relative to the base 13. The hinge rod 78, which is firmly affixed to the base 13, supports the sleeve 80 in relation to the object's base 13. A door arm 58 is attached to each sleeve 80, which causes the sleeve 80 to rotate around the hinge rod 78 when it is moved by an actuator means generally designated 28. In the preferred embodiment, the door arm 58 is a perpendicular extension of the sleeve 80 which extends over the actuator 28. The transformation means 75 is located inside the object 20, and allows the object 20 to open and close relative to the base 13 in response to a triggering event. Wings 79 extend from the sleeves 39 to connect the same with the object parts 14.

Figure 7:
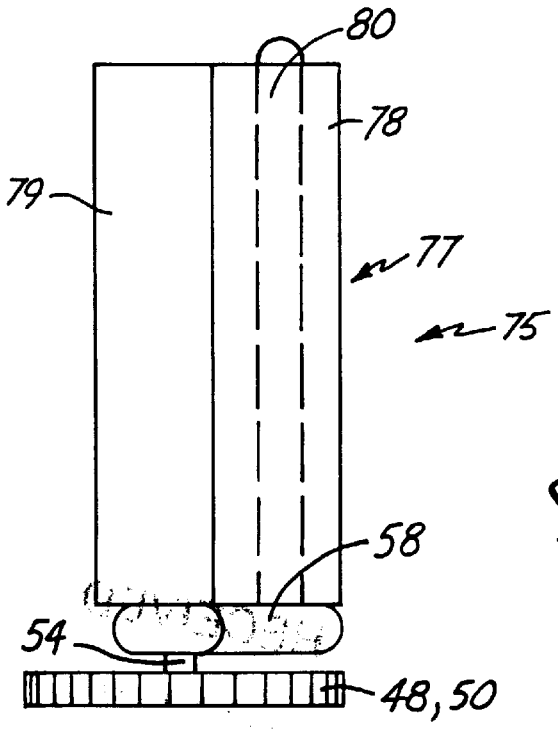
FIG. 7. shows a front view of the transformation mechanism.

In the preferred embodiment, the motion desired to open the toy 20 from its normally closed position, shown in FIGS. 3 and 4, to the open transformed position, shown in FIG. 5, is achieved by the rotation of the push posts or pins 54 on the outer circumference of the push gears 48, 50. As shown in FIGS. 4 and 5, the push posts 54 are posts or pins that extend far enough out of the flat side of the push gears 48, 50 to contact the door arms 58. The push posts 54 are also positioned at a radial distance from the center of the push gears 48, 50 so that rotation of the push gears 48, 50 causes the transformation means 75, as shown in FIGS. 6 and 7, to open the toy 20.

More specifically, when the push posts 54 rotate due to rotation of the gears 48, 50, they contact the door arms 58 of the transformation means 75 and move these door arms apart 58, as shown in FIG. 5. The movement of the door arms 58 causes the toy to open because these door arms 58 are indirectly connected to the object parts 14 by the rotatable portion of the hinges 77. Thus, when the push posts 54 move the door arms 58 apart, the door arms 58 cause the sleeve 80 to rotate around the hinge rod 78, overcoming the biasing force of the spring 70, to open the toy's object parts 14 in relation to the base 13.

Following opening, the toy 20 is closed by a tension spring 70 connecting the two door arms 58 after the motor 30 is automatically turned off by a switch or timer (not shown). The tension spring 70 closes the toy 20 by pulling the door arms 58 back to their original position, as shown in FIG. 4. This spring 70 is strong enough to keep the door arms 58 pressed against the push posts 54 of the push gears 48, 50 but flexible enough to allow the door arms 58 to be forced apart by the push posts 54 of the push gears 48, 50. For example, when the motor 30 turns on, it opens the toy 20 by forcing the arms 58 apart against the resistance of the spring 70, as shown in FIG. 5, and when the motor 30 turns off, the spring 70 pulls the toy 20 closed or back to its home position, as shown in FIG. 4.

Figure 8:
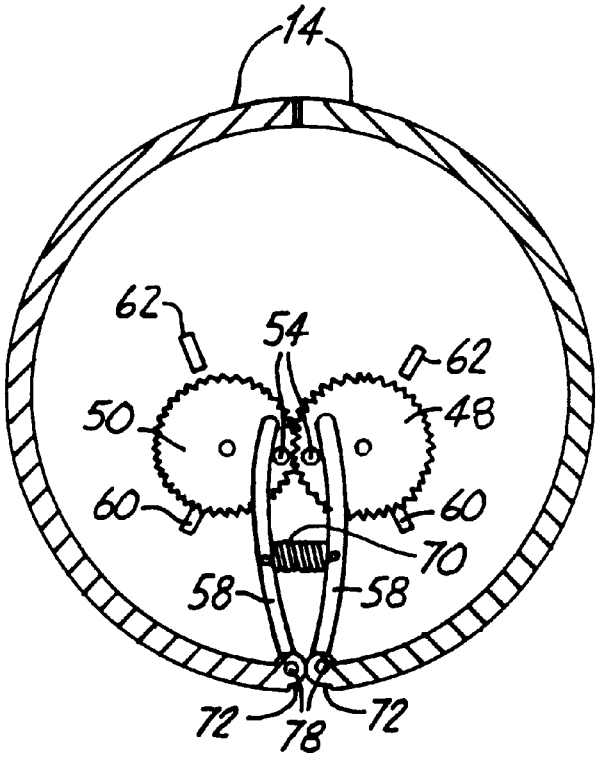
FIG. 8. shows a partial top view of details of the actuator when the object is in a closed position.
Figure 9:
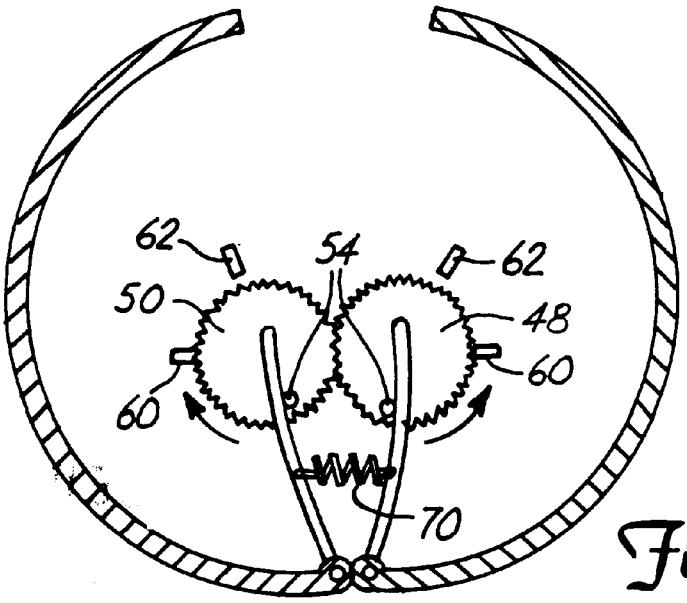
FIG. 9. shows a partial top view of details of the actuator when the object is in an intermediate position.
Figure 10:
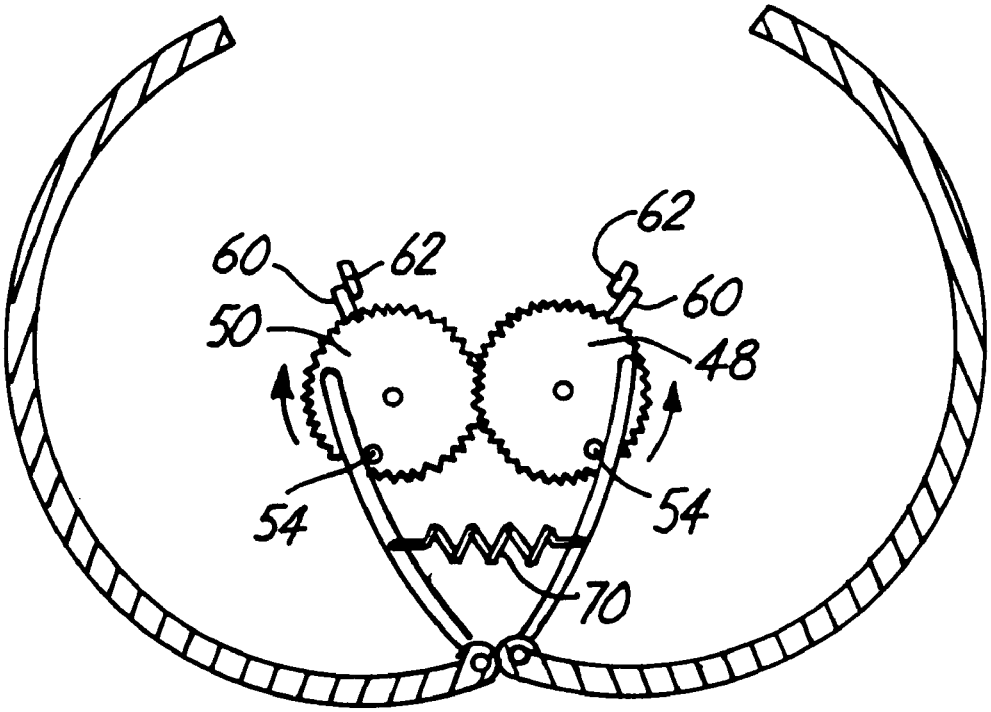
FIG. 10. shows a partial top view of details of the actuator when the object is in a open position.

However, in this embodiment, the spring 70 does not pull the toy 20 closed immediately after it is opened. In this embodiment, the toy's 20 open position is controlled by the location of the stop blocks 62 attached to the base 13 and the stop arms 60 mounted on the push gears 48, 50. FIGS. 8–10 show progressively how the preferred embodiment, as shown in FIGS. 3–5, limits the rotation of the push gears 48, 50. FIG. 8 shows the push gears 48, 50 in their initial normally closed or home position with stop arms 60 extending from the edge of the push gears 48, 50. FIG. 9 shows the push gears' 48, 50 stop arms 60 moving toward the stop blocks 62 attached to the base 13. FIG. 10 shows the push gears 48, 50 in their open position with the stop arms 60 held against the stop blocks 62 until the motor 30 turns off after a preset length of time, preferably only a few seconds. In the preferred embodiment, these stop blocks 62 are both located approximately one-third of a rotation in front of the stop arms 60 home position to assure the object parts 14 open the same distance and hold the object parts 14 in the open position for a few seconds before closing. The stop arms 60 and blocks 62 are used because the spring 70 would cause the object 20 to close immediately if the motor 30 was turned off as a means to limit rotation. Whereas, if the push gears 48, 50 rotation is limited while keeping the motor 30 on, the motor 30 holds the stop arms 60 against the stop blocks 62 and holds the object 20 open until the motor 30 turns off.

To prevent the motor 30 from burning out or the gears 29 from stripping while the motor 30 is running and the gears 29 are stopped, one or more of the gears 29 includes a rubber clutch 40 or slip gear. As shown in FIGS. 4 and 5, in the preferred embodiment the rubber clutch 40 is located on the control gear 38. The rubber used for the rubber clutch 40 is solid enough to operate as a solid gear when the actuator 28 is forcing the object 20 to open against the countervailing force of the tension spring 70, but flexible enough to slip when the object 20 is held shut or the push gear's 48, 50 stop arms 60 hit the stop blocks 62. Thus, the object 20 is held open after the stop arms 60 contact the stop blocks 62 without damaging the actuator 28 because the rubber clutch 40 slips until the push gears 48, 50 return to their home position. In addition to the rubber clutch 40, the actuator 28 can also prevent damage to the motor 30 by using a slip gear. A slip gear is any gear that slips out of engagement when it is prevented from rotating to avoid stripping or damaging the drive motor. For example, a gear held in position by a spring and with the sides of its teeth sufficiently slanted to disengage when prevented from moving. Another example is a pulley gear. A pulley gear is a gear driven by a belt or O-ring. The pulley gears can work as a slip gear because if it is prevented from moving, the belt driving the pulley gear can continue to move without damaging the motor 30.

In an alternative embodiment, the spring 70 for pulling the toy 20 closed may be replaced by two springs connected between the transformation means 75 or object portions 14 and the door arms 58. These springs, like spring 70, apply constant tension to hold the toy 20 closed and are flexible enough to be pushed apart by the door arms 58. Using this embodiment, the push gears 48, 50 can continue to rotate a full rotation after opening the toy 20. In addition, if stops are used to limit the rotation of the door arms 58, the toy or object 20 may also be temporarily held in the open position. In this embodiment, the toy 20 is temporarily held in the open position from the time the door arms 48, 50 are not allowed to open any further until the push gears' push posts 54 rotate out of contact with the door arms 58. The push gears 48, 50 do not stop when the door arms 58 are restrained because the push posts 54 are moving parallel to the door arms 58, which prevents the door arms 58 from closing but does not prevent the push posts 54 or push gears 48, 50 from revolving.

In accordance with the interior operations which have been described in detail during the discussion of the structure of the toy 20, it will be apparent that a person walking in the vicinity of the toy 20 or creating other motion around the toy will trigger a plurality of reactions from the toy 20. The sound card 21 may generate a roaring sound as the person approaches the toy 20. Thereafter, the object 20 will open to reveal an inner chamber 22 and a creature suspended therein 25 will be poised for further action or play. Other varied responses, such as light beams or eye lighting or additional movements can be associated with the outer housing or associated with the creature character or other toy disposed in the chamber hidden therein. Once a complete operational cycle has been experienced, the toy returns to its original closed and waiting state.

The foregoing description of the present invention has been presented for purposes of illustration and description. Furthermore, the description is not intended to limit the invention to the forms described. Consequently, variations and modifications commensurate with the above teachings, and within the skill and knowledge of the relevant art, are part of the scope of the present invention. The embodiments described hereinabove are further intended to explain best modes known of practicing the invention and to enable others skilled in the art to utilize the invention in such, or other embodiments and with various modifications required by the particular applications or uses of the present invention. It is intended that the appended claims be construed to include alternative embodiments to the extent permitted by the scope of the prior art.

What is claimed is:

1. An interactive toy that transforms in response to a triggering event, comprising:

a base;

a triggering means, connected to the base, wherein a triggering event is received;

an actuator, connected to the triggering means, for generating motion, comprising;

motor means for generating rotary motion;

at least one control gear, connected to the motor, to generate and control the gear speed, wherein the control gear has a rubber clutch;

at least one transfer gear, connected to the control gear, and movable in response to operation of the control gear;

a first push gear, connected to the transfer gear, and movable in response to operation of the transfer gear, said first push gear having a first push post which extends from one side thereof and a first stop arm extending over the edge thereof;

a second push gear, connected to the first push gear, and movable in response to operation of the first push gear, said second push gear having a second push post which extends from one side thereof and a second stop arm extending over the edge thereof;

a first stop block, connected to the base, to limit the first push gear's rotation when contacted by the first stop arm;

a second stop block, connected to the base, to limit the second push gear's rotation when contacted by the second stop arm;

a transformation means, connected to the actuator, and operable responsively to operation of the actuator, comprising:

a first hinge, connected to the base, to permit motion relative the base, comprising:

a first hinge bar; and a first sleeve, rotatable surrounding said first hinge bar;

a second hinge, connected to the base, to permit motion relative the base, comprising:

a second hinge bar; and a second sleeve, rotatable surrounding said second hinge bar;

a first door arm, connected to the first sleeve, engageable by said first push post to cause said first sleeve to rotate about said first hinge bar;

a second door arm, connected to the second sleeve, engageable by said second push post to cause said second sleeve to rotate about said second hinge bar;

a biasing spring, connected between the first and second door arm;

a first object part, connected to the first sleeve, and moveable in conjunction with said first sleeve;

a second object part, connected to the second sleeve, and moveable in conjunction with said second sleeve;

said first and second object parts defining an inner chamber, which is opened after the movement of the first object part and the second object part; and a secondary object contained within the inner chamber.

* * * * *